United States Patent [19]

Heydemann

[11] 3,942,678

[45] Mar. 9, 1976

[54] INSULATING CONTAINER

[76] Inventor: Richard-Wilhelm Heydemann, Via Tagliaferri Blocco A., CH-6911 Campione, Lago di Lugano, Switzerland

[22] Filed: Oct. 29, 1973

[21] Appl. No.: 410,406

[52] U.S. Cl. ..... 220/342; 220/21; 220/3.1; 206/434; 206/203; 220/4 B

[51] Int. Cl.[2] ..... B65D 51/04

[58] Field of Search ..... 220/31, 3.1, 23.83, 20, 220/21, 253, 334, 337, 341, 342

[56] References Cited

UNITED STATES PATENTS

| | | | |
|---|---|---|---|
| 2,740,632 | 4/1956 | Balmer | 220/31 R X |
| 3,531,823 | 10/1970 | Cornelius | 220/31 R X |
| 3,633,785 | 1/1971 | Cyr et al. | 220/20 |
| 3,705,222 | 12/1972 | Rogers et al. | 220/20 |

*Primary Examiner*—William I. Price
*Assistant Examiner*—Steven M. Pollard
*Attorney, Agent, or Firm*—Walter Becker

[57] ABSTRACT

A temperature insulating receptacle, e.g. of styrofoam or polyurethane, which is composed of two sections hinged together so as to be adapted to be folded like a suitcase while the ends opposite the hinging means are provided with interengaging closure means a part of which simultaneously serves as a handle.

1 Claim, 1 Drawing Figure

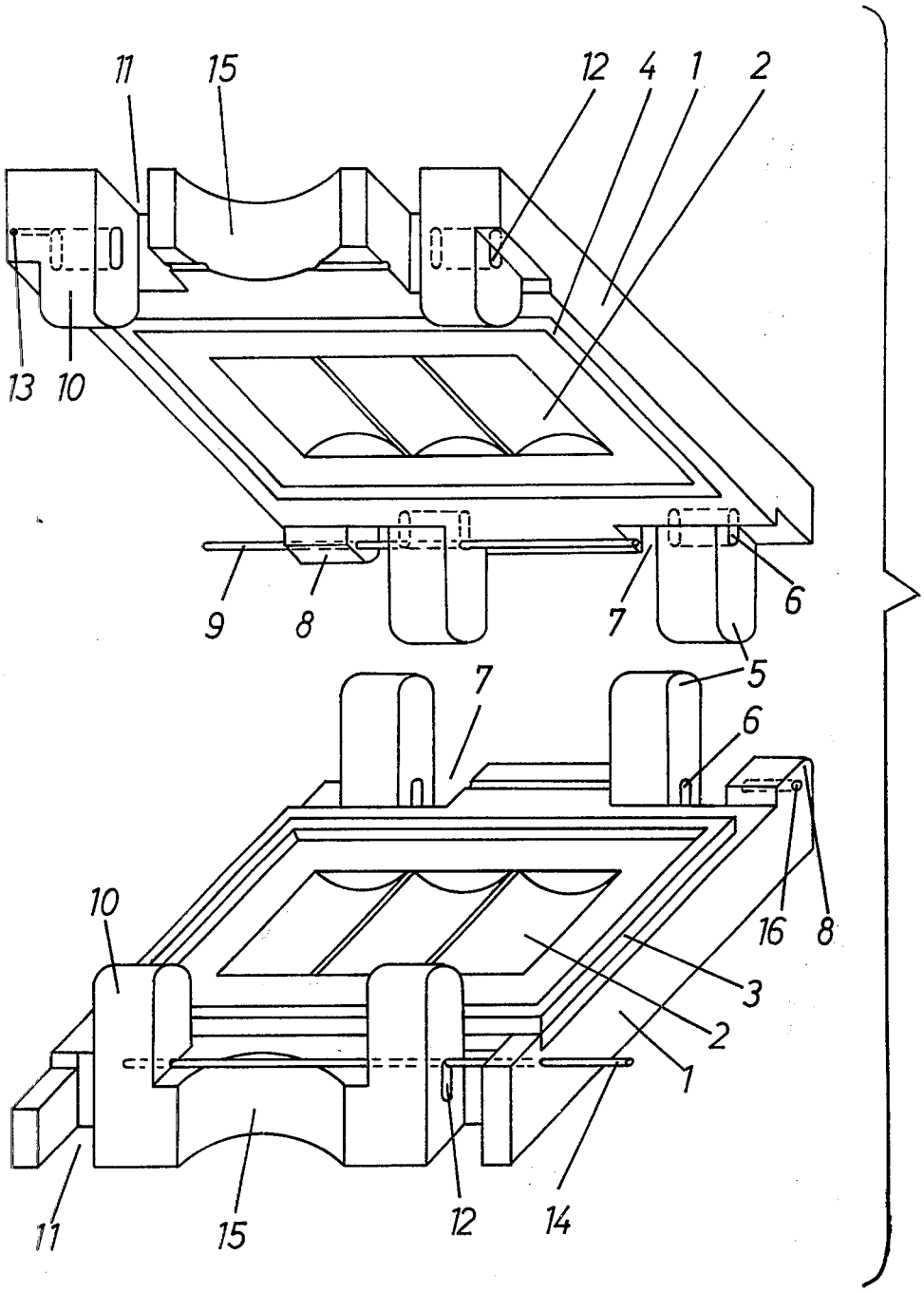
11
15
12
4
1
2
13
10
9
8
7
6
5
7
6
10
16
8
3
2
1
11
15
12
14

INSULATING CONTAINER

The present invention relates to an insulating container for maintaining certain temperatures to preserve and transport food, beverages, etc. For camping purposes, especially for day excursions to the beach, it is known to transport and keep beverages in so-called cooler bags in order to protect the same against undue warm temperatures. Such bags, which as a rule can be closed by a zipper, comprise a frame which has mounted thereon a double wall textile or synthetic material which encloses an insulation consisting of fibers. These bags are expensive to manufacture and, considering the price, have a relatively poor insulating effect.

It is, therefore, an object of the present invention to provide an insulating container which can be made at a relatively low cost and is very efficient. This object and other objects and advantages of the invention will appear more clearly from the following specification in connection with the accompanying drawing illustrating an isometric view of the two sections of the insulating container prior to their assembly. The insulating container according to the present invention is characterized primarily in that the two sections of the container are pivotally interconnected by a hinge and on that side which is located opposite the hinge have a closure serving as a handle for carrying the insulating container.

The insulating container according to the invention may be made in a simple manner of hard foam material, for instance, polyurethane or styrofoam, and has the form of a small suitcase and is easy to handle.

For purposes of forming the hinge, one side of each section of the container may be provided with extensions which preferably have oblong openings, adjacent to which there are provided corresponding recesses. Wall portions arranged adjacent to said recesses and pertaining to the sections of the container have bores which are in alignment with the oblong openings and into which a bar is insertable. In order to obtain an insulating container which can be unfolded, it is in conformity with the invention necessary only to place two sections adjacent to each other in such a way that the extensions engage the recesses, and to introduce a bar, for instance of synthetic material, into the bore, whereby the two sections can be quickly and simply connected to each other to form a suitcase shaped insulating container which can be opened up in the manner of a suitcase.

According to a preferred embodiment of the insulating container according to the invention, its closure is simultaneously designed as a handle and is obtained by each section of the container having that side thereof which is located opposite to the hinge provided with protrusions having preferably oblong openings and with recesses which correspond to said protrusions and into which the protrusion of the other section can be inserted. That section of the container which is located within the region of said protrusions has a bore which is in alignment with the oblong openings and is adapted to receive a bar, while said last-mentioned section in the center of its side has a recess for releasing the inserted bar. When the container is filled and folded together, it is merely necessary in order to close the container to introduce the bar into the bores of the sections. This bar can within the region of the recess be grasped as a handle.

Referring now to the drawings in detail, the insulating container illustrated therein comprises two sections 1 which are preferably made by injection molding of hard foam material. The sections are on the inner side provided with depressions 2, for instance for holding cans containing beverages. Around the depressions 2 there is provided a frame-like rib 3 in one section and a corresponding groove 4 in the other section. The said rib and groove engage each other when the container is closed, thereby improving and enhancing the insulating effect.

At one marginal portion of each section 1 there are provided two extensions 5 with oblong openings 6, which extensions are adapted to be inserted into corresponding recesses 7 adjacent to the extensions 5 of the other section. The wall portions which are adjacent to the recesses 7 are partly provided with elevations 8 which have a bore 16 aligned with the longitudinal openings 6. When the sections 1 are connected to each other, a bar 9 is inserted into the bore 16 through the oblong openings 6. This bar 9 forms the bolt of a hinge so that the two sections 1 are held together in the manner of the two sections of a suitcase.

In order to prevent an accidental opening of the insulating container during its transport, and in order simultaneously to obtain a handle for facilitating the handling of the insulating container, the sections 1 are on that side thereof which is located opposite the extensions 5 provided with protrusions 10. When the container is closed, these protrusions 10 engage corresponding recesses 11 of the oppositely located section 1 and have oblong openings 12. In this side there is furthermore provided a bore 13 which is in alignment with the oblong openings 12. A bar 14 can be inserted into said bore 13 and holds together the two sections 1 when they engage each other. In the center of this side, the sections 1 are additionally provided with a recess 15 which exposes the bar 14 to such an extent that it can be grasped in the manner of a handle.

It is, of course, to be understood that the present invention is by no means limited to the specific showing in the drawings, but also comprises any modifications within the scope of the appended claims.

What is claimed is:

1. A portable temperature insulating receptable for storing and transporting containers for beverages and food comprising two complementary, molded sections of insulating material, said sections having plane meeting faces surrounding partial, complementary, closely adjacent cavities in each section to form complete cavities when said sections are closed, complementary rib and groove formations on said plane faces interfitting to form a tight closure and surrounding all said cavities when said sections are closed, one edge of each section having a pair of molded extensions projecting over the edge of the other section, so that said extensions are aligned transversely, aligned openings in said extensions and a rod through said aligned openings with said rod in the plane of said meeting faces to form a hinge, the opposite edges of said sections having molded projections overlapping the edges of the sections and recesses on said sections receiving said projections, said sections having central meeting portions between said projections and recesses, aligned openings through said projections and the walls of said recesses, and a rod through said openings to maintain said sections closed, said central portions being cut out with said rod through the space formed by the cut out portions to provide a carrying handle.

* * * * *